US005487705A

United States Patent [19]

Clarke

[11] Patent Number: 5,487,705

[45] Date of Patent: Jan. 30, 1996

[54] BABY CAROUSEL

[76] Inventor: William A. Clarke, 4549 Budd Dr., Erie, Pa. 16506

[21] Appl. No.: 126,040

[22] Filed: Sep. 23, 1993

[51] Int. Cl.[6] ..... A63G 1/10

[52] U.S. Cl. ..... 472/29; 472/36; 297/256.12

[58] Field of Search ..... 472/1, 27, 28, 472/29, 35, 36, 37, 43; 297/344.21, 344.23, 344.26, 256.12, 188, 194; 5/600, 655, 656; 40/455, 414, 411; 248/425, 429, 430

[56] References Cited

U.S. PATENT DOCUMENTS

| | | | |
|---|---|---|---|
| 2,567,418 | 9/1951 | Barker | 297/194 |
| 3,834,660 | 9/1974 | Leffler | 248/425 |
| 4,862,530 | 9/1989 | Chen | 5/616 |
| 4,936,629 | 6/1990 | Young | 297/256.12 |
| 4,969,685 | 11/1990 | Chihaya et al. | 297/344.23 |
| 5,030,485 | 7/1991 | Meeks et al. | 40/455 X |
| 5,110,636 | 5/1992 | Hou | 40/455 X |
| 5,314,365 | 5/1994 | Chen | 40/411 X |

*Primary Examiner*—Carl D. Friedman
*Assistant Examiner*—Kien T. Nguyen
*Attorney, Agent, or Firm*—Richard K. Thomson

[57] ABSTRACT

An infant entertainment device having a molded plastic seat which rotates a baby carried thereby at a rate of about one rpm relative to a stationary base member. Optionally, the carousel may be equipped with a rheostat capable of varying the rate of rotation between one-half and four rpm. Music is provided by a microchip, for example, or at the option of the operator, the carousel may be operated without music. An optional accessory bar may be provided to support amusement devices in the baby's view.

19 Claims, 3 Drawing Sheets

BABY CAROUSEL

FIELD OF THE INVENTION

The present invention is directed to a device for entertaining an infant. More particularly, the present invention is directed to a baby carousel for rotating an infant, preferably, while playing a song.

BACKGROUND AND SUMMARY OF THE INVENTION

Entertaining an infant is easy at a large family gathering. The baby can simply be passed from one pair of waiting arms to the next. However, when mom is home alone with the baby or at a smaller get-together, what to do with the baby when he or she is awake can become a problem. When left in a car seat, bassinet, playpen or the like, the baby quickly becomes bored and cranky. While a swing or jumper seat may provide some entertainment for toddlers, these devices are frequently inappropriate for infants and provide only a respite of limited duration from the inevitable boredom associated with looking at the same thing.

The present invention is directed to an entertainment device for infants comprising a stationary base, a seat which receives the baby in a semi-reclined position, a motor for rotating the seat relative to the base and a source of power for the motor. Preferably, the infant carousel is equipped with a programmed microchip, a music box, or the like, which plays a lullaby or other soothing music which will induce sleep. The power source may be an a.c. source but is preferably a d.c. battery or mechanical spring in order to eliminate the need to plug into a wall socket.

This infant carousel rotates the baby through 360°, preferably at a rate of between one-half and four revolutions every minute, allowing her/him to see everyone and everything in the room. Further, everyone in the room gets a good view of the baby. This is unlike a conventional swing which gives the baby and the onlookers the same view all the time. The preferred embodiment employs a one-piece molded plastic seat member which is contoured to receive the child. The seat member is preferably equipped with a seat belt to prevent the child from falling or crawling out of the device. Additionally, an accessory bar may optionally be provided as a means to mount mobiles, dangling toys, or the like, to entertain the child.

Various other features, advantages and characteristics of the present invention will become apparent after a reading of the following specification.

DETAILED DESCRIPTION OF THE PREFERRED EMBODIMENTS

Figure 1:
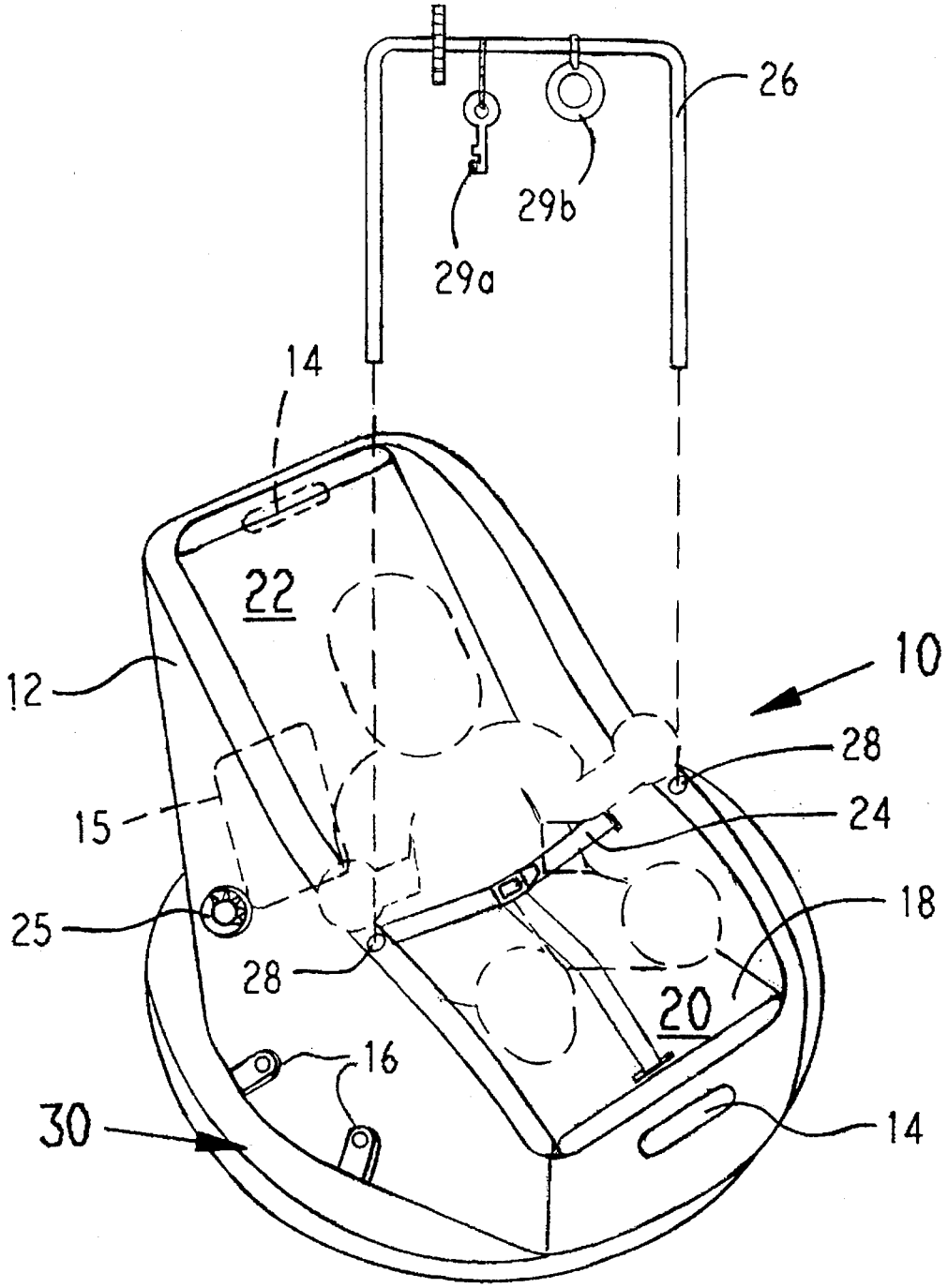
FIG. 1 is a perspective view of the infant carousel of the present invention.

The infant carousel of the present invention is depicted in FIG. 1 generally at 10. Carousel 10 includes seat member 12 which is preferably a molded plastic part with integral hand grips 14. While plastic seat member 12 may be vacuum formed, it is most preferably made as an injection molded part. Snaps 16 secure seat 12 to base member 30. In lieu of snaps 16 pop rivets (not shown) may be used to couple the seat 12 to base 30. Comfort seat 18 fits snugly in the bottom of the contoured seat 12 so that the semi-reclined infant can rest comfortably. Bottom 20 and back 22 of seat 12 form substantially a right angle that is reclined from horizontal and vertical, respectively, an angle of between 10° and 45° with 30° being preferred.

Carousel 10 preferably includes a strap 24 to buckle in the child and prevent the baby from rolling or crawling out of the device, though typically, the baby will not be of an age to be crawling. The carousel 10 of the present invention is designed to accommodate infants from newborn to six months of age. Typically, an infant under six months of age will not exceed thirty pounds, which is well within the capabilities of the device to support. An optional attachment bar 26 can be received in apertures 28 and may provide a means to suspend a key **29*a*, a ring 29*b*, or other toys such as mobiles or, possibly, a pacifier to entertain the child. Molded seat 12 has a removable back panel 15 which provides access to the electrical components for servicing as discussed further below. Switch 25** provides the capacity to control the operation of the device as will also be discussed later.

Figure 2:
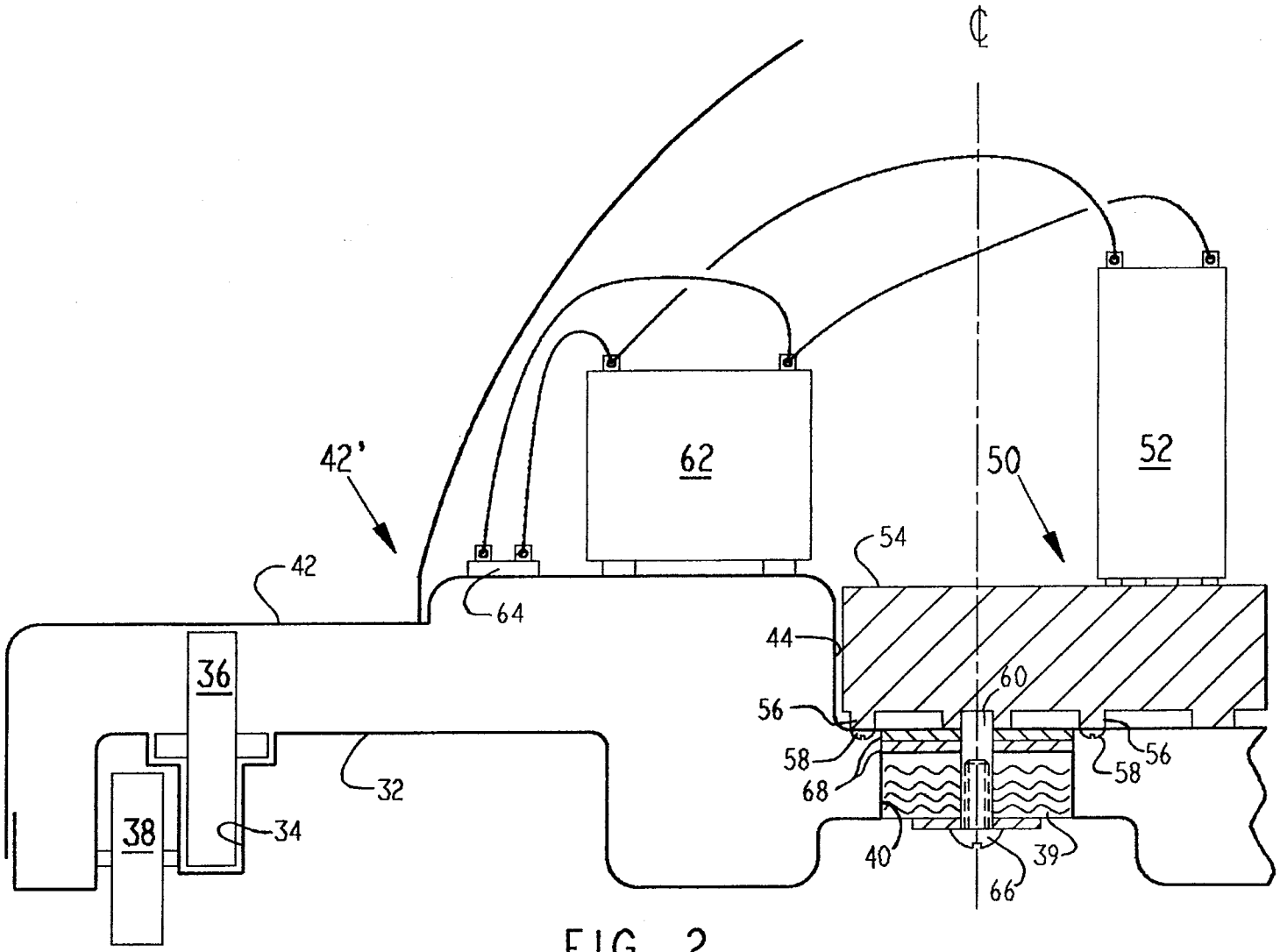
FIG. 2 is a schematic side view with portions broken away to depict the positions of the inner elements.
Figure 4:
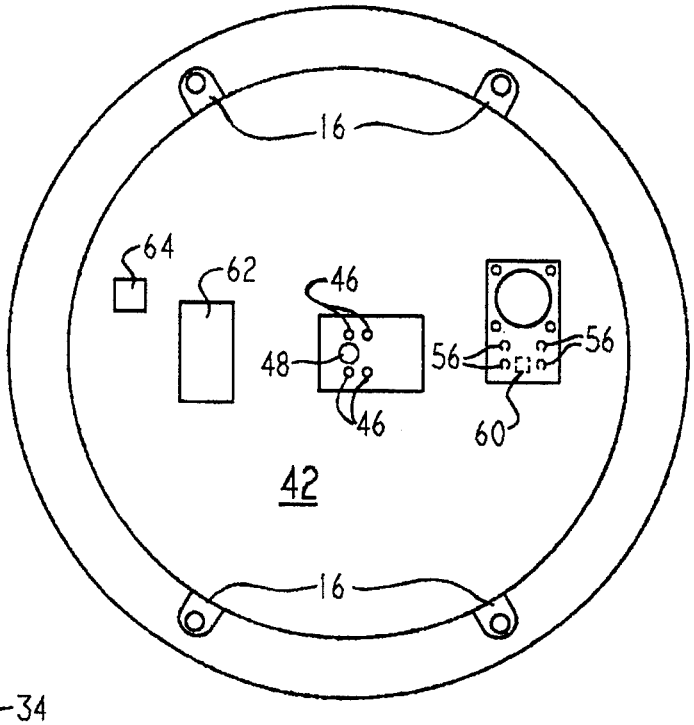
FIG. 4 is a top view of the rotational base with the drive element displaced from the molded receptacle.
Figure 3:
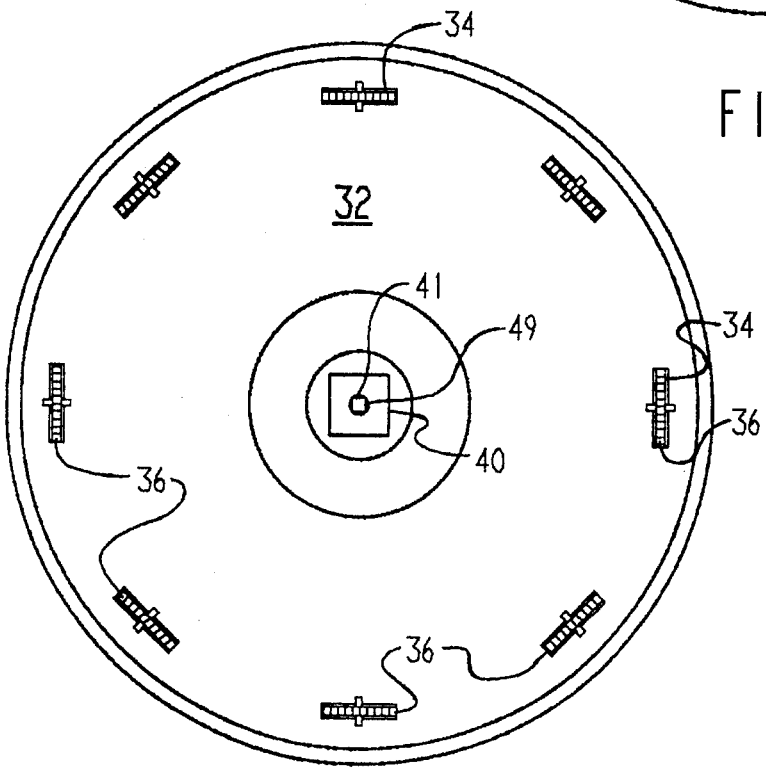
FIG. 3 is a top view of the stationary base.

As can be seen more clearly in FIGS. 2–4, base member 30 includes a stationary base 32 and a rotational base 42. Stationary base 32 has a plurality (eight shown) of recesses 34 which are molded directly into stationary base to receive support rollers 36. Rollers or wheels 36 are preferably made of a self-lubricating material such as TEFLON polymer or a filled nylon, although other materials, such as aluminum, can be used. Stationary base 32 may be provided with casters 38 mounted on its lower surface to permit the carousel 10 to be moved more easily from place to place. A square pillow block 39 is received in a square recess 40 molded into the underneath portion of base 32. Pillow block 39 is of a size to be press fit into recess 40. Alternatively, pillow block 39 maybe integrally molded into recess 40. Block 39 has a non-round opening 41, shown in FIG. 3 as square.

As best seen in FIG. 2, rotational base 42 sits atop support rollers 36 which serve as bearing means. It will be appreciated that other bearing means (e.g., ball bearings, roller bearings, etc.) could be used to permit relative rotation between stationary base 32 and rotational base 42. Rotational base 42 has a recess 44 molded therein for receiving drive element 50. Drive element 50 includes motor 52 and a gear box 54. Motor 52 can be any off-the-shelf commercially available motor capable of between 800 and 1000 rpm in the no load condition and capable of producing 30 in-lb of torque. Gear box 54 should be able to reduce the rpm to one revolution per minute (i.e., have a reduction ratio on the order of about 1000 to 1). While any commercially available gear reduction box meeting these criteria could be used, one such reducer is available from Rex as gear motor model CXCR1, spec. no. 2994. Alternatively, a conventional mechanical spring drive of the type used to rotate music box elements can be used to provide rotation.

Four posts 56 project from gear box 54 and are received through openings 46 in rotational base 42 and secured thereto by fasteners 58. Nonround drive shaft 60, square in this embodiment, extends from gear box 54 through opening 48 in rotational base 42, round opening 49 of stationary base 32 and is received in similarly shaped opening 41 in block 38. Power source 62 which is connected to motor 52 is preferably a 6 volt d.c. battery, although with a different choice of motor, alternating current from a standard wall socket could be used. However, battery 62 is preferred in order to make carousel 10 more versatile and to eliminate the risk to parents and siblings of cords to trip over. Most preferably, battery 62 may be four D size batteries which may easily be changed by the operator. A microchip 64 provides music, at the option of the operator, which may, for example, play Brahm's Lullaby. Alternatively, music could be provided by a conventional pin-drum music box. Switch 25 maybe provided with a rheostat to permit the rate of rotation to be varied over a range from about ½ to about 4 rpm. In addition, switch 25 will provide the operator the capability to shut off the music if mom's jangled nerves prefer the sound of silence. A pair of washers 66 are positioned between stationary base 32 and rotational base 42 to further facilitate relative rotation therebetween. A bolt 68 is threaded into the end of square drive shaft 60 to complete the assembly of stationary base 32 with rotational base 42 which has seat member 12 secured thereto.

When switch 25 is turned to the 'on' position, motor 52, through gear box 54, will try to rotate shaft 60 and attached stationary base 32 in a first (clockwise) rotational direction. However, since the resistance to movement of the stationary base will generally be greater than the resistance to movement of the rotational base 42 on support rollers 36, motor 52 will rotate the rotational base assembly 42' (together with the motor and gear box) in an opposite (counterclockwise) rotational direction. Microchip 64 will provide music if the operator rotates switch 25 to a position to select music. Alternatively, a separate switch (not shown) can be provided to control the music. Motor 52 could be positioned between stationary base 32 and rotational base 42 with drive shaft 60 extending upwardly in order to rotate base 42 in a more conventional manner. However, such a modification would be at a significant cost to the low profile afforded by the preferred design. With the drive element 50 positioned within recess 44 the top of base member 30 is no higher than three inches above the surface upon which it is positioned and the top of the seat 12 is not more than sixteen inches high. Since the base has a diameter of about twenty-six inches, carousel 10 is extremely stable and is virtually impossible to tip over, providing a safe, reliable amusement device for infants up to thirty pounds in size.

Various changes, alternatives and modifications will become apparent following a reading of the foregoing detailed description of the present invention. It is intended that all changes, alternatives and modifications as fall within the scope of the appended claims are considered part of the present invention.

What is claimed is:

1. An entirely portable infant entertainment device comprising:

a) a stationary base;

b) a seat member rotationally attached to said base for receiving an infant in a semi-reclined position;

c) a drive element for rotating said seat member relative to said base member to entertain said infant;

d) means for supplying power to said drive element; and, e) means for playing music when said seat member is activated.

2. The infant entertainment device of claim 1 further comprising a retaining strap for securing said infant in said seat.

3. The infant entertainment device of claim 1 wherein said drive element comprises a motor and a gear box to control a rate of rotation of said seat member in a range of between one-half and four revolutions per minute.

4. The infant entertainment device of claim 3 further comprising control means to permit the rate of rotation to be selectively varied within said range.

5. The infant entertainment device of claim 1 further comprising means for rotationally mounting said seat member atop said stationary base including a rotational base and a plurality of bearing means positioned in said stationary base and supporting said rotational base.

6. The infant entertainment device of claim 5 wherein said drive element is attached to said rotational base and is received in a recess formed therein.

7. The infant entertainment device of claim 6 further comprising a block received in a portion of said stationary base, said block having a nonround aperture which receives a similarly shaped drive shaft portion of said drive element.

8. The infant entertainment device of claim 5 wherein said bearing means comprise a plurality of rollers received in supporting apertures mounted in said stationary base.

9. The infant entertainment device of claim 1 wherein said means for supplying power comprises a d.c. battery.

10. The infant entertainment device of claim 1 further comprising wheels secured to one of said base and said seat member and rotationally engaging the other of said base and said seat member in order to permit relative rotation therebetween.

11. The infant entertainment device of claim 1 wherein said member comprises a one-piece molded plastic element including a contoured portion to receive said infant in a semi-reclined position.

12. The infant entertainment device of claim 11 wherein said contoured portion comprises a seat portion and a seat back forming approximately a right angle, said seat portion and seat back being inclined from about 10° to about 45° from an upright position.

13. The infant entertainment device of claim 1 wherein said seat member includes a comfort cushion positioned within said contoured portion.

14. The infant entertainment device of claim 1 further comprising casters attached to a lower portion of said stationary base.

15. The infant entertainment device of claim 1 further comprising an accessory bar attached to said seat member for mounting toys in the view of said infant.

16. An entirely portable infant entertainment device comprising:

a) a stationary base;

b) a seat member rotationally attached to said base for receiving an infant in a semi-reclined position;

c) a drive element for rotating said seat member relative to said base member to entertain said infant;

d) means for supplying power to said drive element; and e) wheels secured to one of said base and said seat member and rotationally engaging the other of said base and said seat member in order to permit relative rotation therebetween.

17. An infant entertainment device comprising:

a) a stationary base;

b) a seat member rotationally attached to said base for receiving an infant in a semi-reclined position;

c) a drive element for rotating said seat member relative to said base member to entertain said infant;

d) means for supplying power to said drive element; and e) casters attached to a lower portion of said stationary base.

18. The infant entertainment device of claim 17 further comprising means for playing music when said seat member is activated.

19. The infant entertainment device of claim 18 further comprising a switch to permit disengagement of said means for playing music.

* * * * *